US006158977A

United States Patent [19]

Ochiai et al.

[11] Patent Number: 6,158,977

[45] Date of Patent: Dec. 12, 2000

[54] AIR CYCLE COOLING SYSTEM

[75] Inventors: Tomiaki Ochiai; Masayuki Sayama, both of Tochigi, Japan

[73] Assignee: Tochigi Fuji Sangyo Kabushiki, Tochigi, Japan

[21] Appl. No.: 09/071,579

[22] Filed: May 1, 1998

[30] Foreign Application Priority Data

May 8, 1997 [JP] Japan ..... 9-118344

[51] Int. Cl.[7] ..... F04B 17/00

[52] U.S. Cl. ..... 417/323; 417/365; 417/374; 417/406

[58] Field of Search ..... 417/323, 365, 417/374, 407, 406

[56] References Cited

U.S. PATENT DOCUMENTS 2,925,723 2/1960 Hagen et al. ..... 62/402
3,141,310 7/1964 Hoffstrom ..... 62/402
3,975,117 8/1976 Carter ..... 417/370
4,105,372 8/1978 Mishina et al. ..... 417/243
5,535,601 7/1996 Teraoka ..... 62/402

*Primary Examiner*—Timothy P. Solak
*Attorney, Agent, or Firm*—Morrison & Foerster

[57] ABSTRACT

A cooling system is simple in structure, efficient, and durable due to a lowered burden on bearings and reduced loss of drive power. The cooling system includes a compressor having a first rotor for compressing air, a cooler for cooling high-temperature, high-pressure air delivered form the compressor, and an expander having a second rotor for effecting adiabatic expansion of air cooled by the cooler. The expander has a speed change mechanism for transmitting drive torque of a prime mover to the compressor and a common shaft that extends through the first and second rotors. The expander is interposed between the speed change mechanism and the compressor.

14 Claims, 5 Drawing Sheets

AIR CYCLE COOLING SYSTEM

BACKGROUND OF THE INVENTION

1. Field of the Invention

The present invention relates to a cooling system such as for air conditioning of a vehicle passenger room or refrigeration in a refrigerator car.

More specifically, the invention relates to an improvement in arrangement of a cooing system including an air compressor connected to a cooler, an air expander connected to the cooler and coupled with the compressor, and a speed change gear for driving the compressor.

2. Description of Relevant Art

It is difficult to find a prior-art technique of the present invention in the most concerned field. Therefore, relevant techniques in neighboring fields will be described below to help understand a background of the invention.

Figure 1:
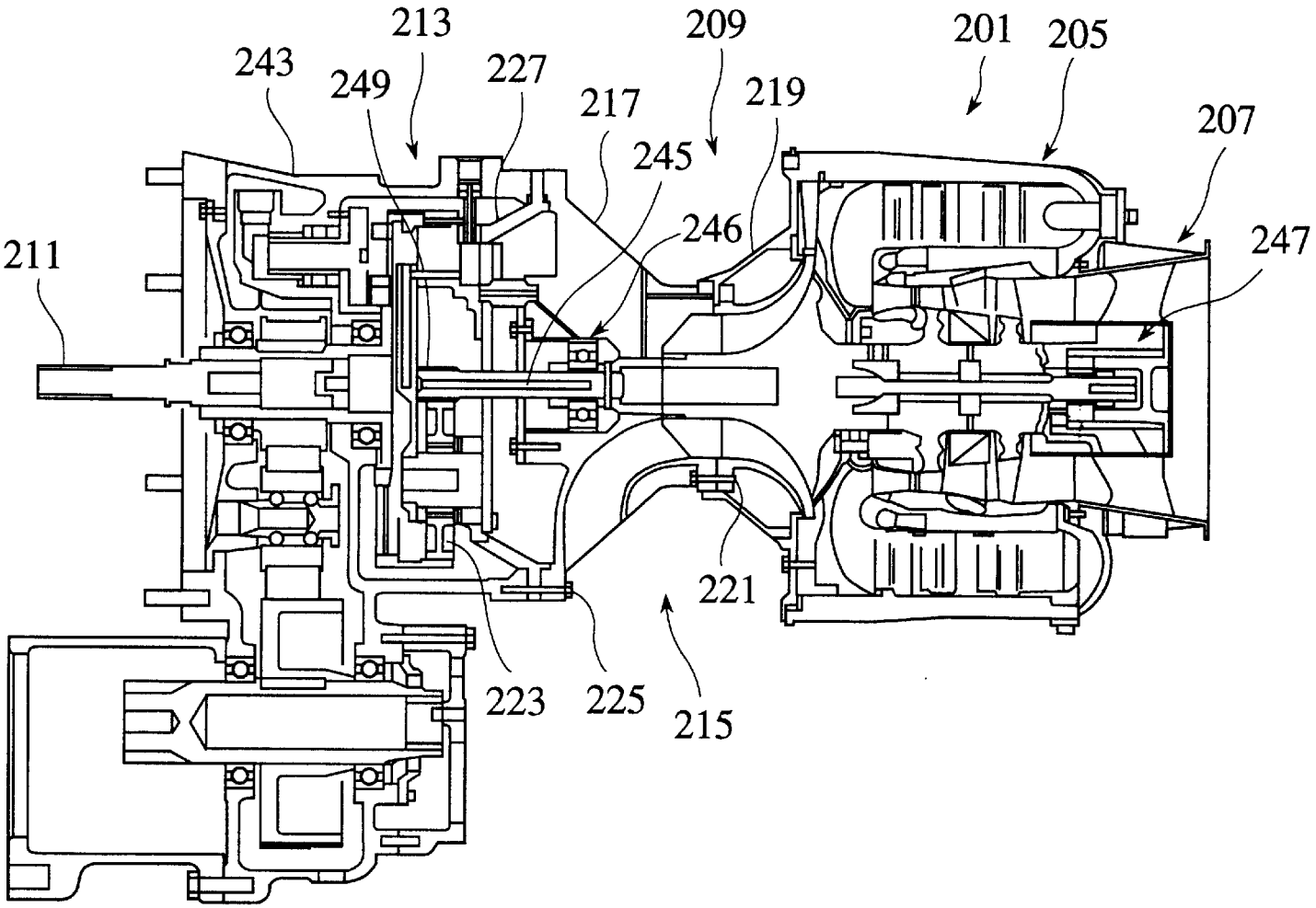
FIG.1 PRIOR ART
FIG. 1 illustrates a gas turbine apparatus 201 described in page 144, B7 of "Mechanical Engineering, Handbooks A (bases) and B (applications)" issued on Sep. 30, 1991, by the Japan Society of Mechanical Engineers, in Japan.

The gas turbine apparatus 201 of FIG. 1 includes a combustor 205, a turbine 207 to be driven with combustion gases from the combustor 205, a compressor 209 to be driven by the turbine 207, and a reduction gear 213 of a planetary gear type adapted to transmit drive torque from the turbine 207 in a speed reducing manner and provided with an output shaft 211 for outputting drive torque with a reduced revolution speed.

The compressor 209 is arranged between the turbine 207 and the reduction gear 213.

The compressor 209 has a housing 215 composed of separate members: a suction side member 217 and a discharge side member 219 fastened together with bolts 221. The reduction gear 213 includes a flange member 227 fixed by bolts 225 to the compressor housing 215, and pinion gears 223 supported by the flange member 227.

The turbine 207 and the compressor 209 generate thrust forces, which are born with thrust bearings arranged at the (left) side where the reduction gear 213 is installed.

Figure 2:
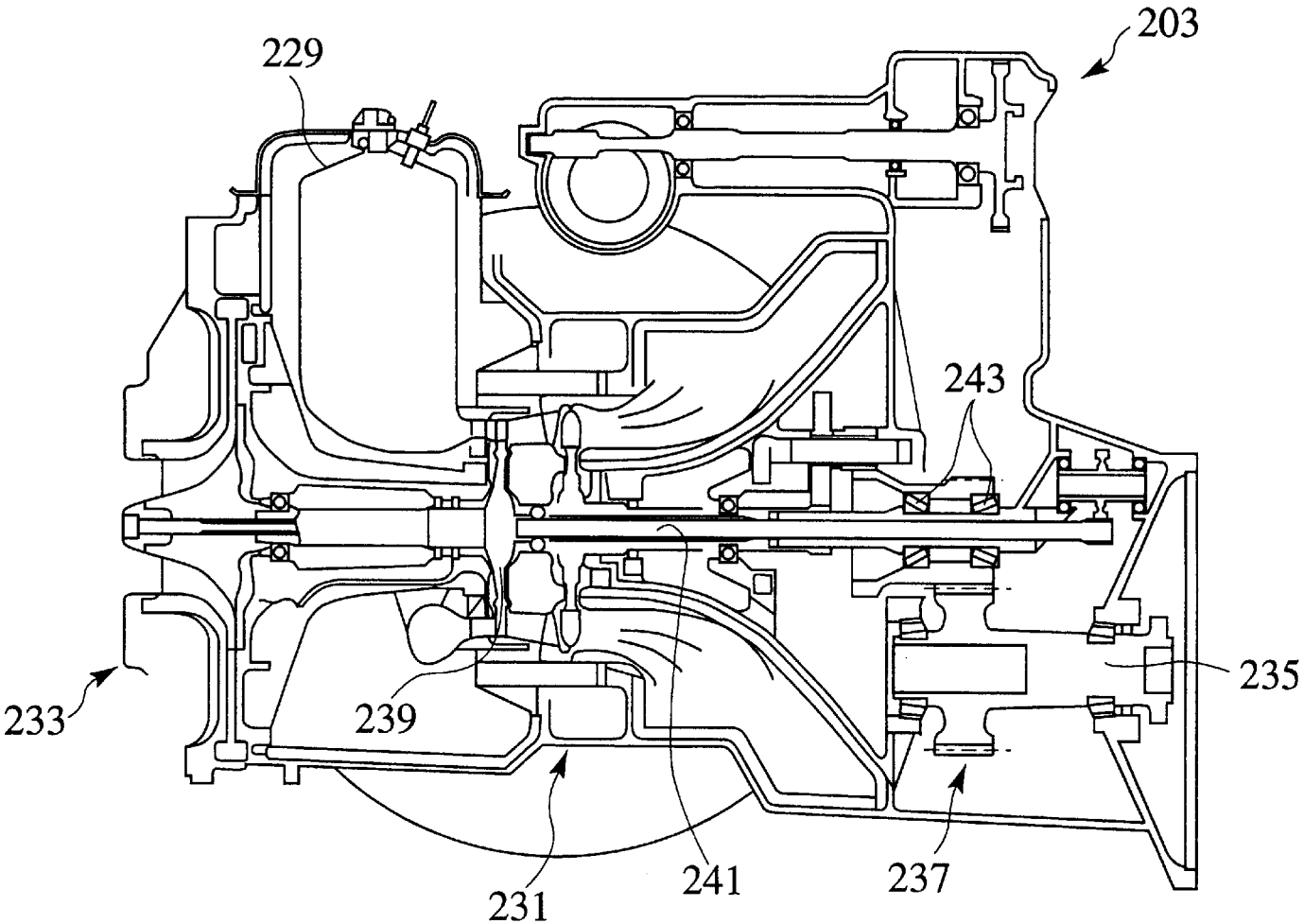
FIG.2 PRIOR ART
FIG. 2 illustrates a gas turbine apparatus 203 described in page 120 of a volume of "Rotary Engine/Gas Turbine" of six "Automobile Engineering Books" issued on Jan. 20, 1980, by Sankaido Co., Ltd, in Japan.

The gas turbine apparatus 203 of FIG. 2 includes is a combustor 229, a turbine 231 to be driven by combustion gases from the combustor 229, a compressor 233 to be driven by the turbine 231, and a reduction gear set 237 adapted to transmit drive torque from the turbine 207 in a speed reducing manner and provided with an output shaft 235 for outputting drive torque with a reduced revolution speed.

The turbine 231 is arranged between the compressor 233 and the reduction gear set 237.

The turbine 231 is provided with a rotor 239, which has a separated shaft 241 on the (right) side to be connected to the reduction gear set 237. The separation of shaft 241 is effective to prevent unfavorable heat transmission from the turbine 231 end, where the rotor 239 is exposed to hot combustion gases, to the gear set 237 end, where associated bearings 243 as well as meshing gears should be kept free from adverse thermal influences.

The gas turbine apparatus 201 or 203 may be applied to an air conditioner or freezer using air as a coolant.

In the gas turbine apparatus 201 of FIG. 1, however, the compressor 209 which generates a negative pressure neighbors with the reduction gear 213 of which a casing 243 has therein an atmospheric pressure, and lubricant has a tendency to leak from within the casing 243 toward the compressor 209, due to the negative pressure.

In application of this apparatus 201 to an air conditioner or freezer, compressed air is expanded to be cooled by an expander, such as a turbine, and delivered therefrom to an air-conditioned room or freezing room. Therefore, the delivered cold air tends to have mixed oil.

For practical use of the cold air, the mixed oil should be removed by an oil separator or the cooling system in concern should have a closed cycle.

The oil separator is expensive. The closed cycle needs an evaporator for heat exchange, and tends to be complex and large-sized, resulting in a dear cost with a reduced efficiency (i.e. increase in COP: coefficient of power as a ratio of reduction to an input).

Moreover, in the application in concern, the reduction gear 213 has a shaft 245 thereof supported by a pair of left and right bearings 246, 247, whereby a sun gear 249 formed at a left end of the shaft 245 is supported in a cantilevered manner.

Therefore, the left bearing 246 bears an increased load in dependence on a shaft projection length therefrom to the sun gear 249, and the left and right bearings 246, 247 have different loads shared thereto, with increased losses of friction and drive torque, resulting in a reduced durability.

Further, the housing 215 of the compressor 209 is separated into the suction side and discharge side members 217, 219 and the pinion gears 223 of the reduction gear 213 are supported by the flange member 227 separated from the housing 215, needing a precise machining with high accuracy for a required centering of the respective separate members 217, 219, 227 as well as of respective gears in the reduction gear 213, resulting in an increased machining cost.

To this point, if the centering be incomplete, the gas turbine apparatus 201 would fail to perform a high-speed revolution, accompanying vibrations, causing a reduced durability.

Still more, the separate members 217, 219, 227 need the bolts 221, 225 for their fixing, resulting in the more increased number of component parts, with the more reduced adaptiveness for assemblage.

Yet more, the thrust bearings arranged at the reduction gear 213 side may constitute a difficulty, when assembling the gas turbine apparatus 201. Besides, possible errors in assemblage of the respective members may be accumulated on the side the compressor 209 and the turbine 207 are installed, with enlarged gaps between rotors and housings, having a reduced heat insulating efficiency.

On the other hand, in the gas turbine apparatus of FIG. 2, the rotor 239 of the turbine 231 is separated from the shaft 241 on the reduction gear set 237 side, thus needing a precise machining with high accuracy for a required centering of the rotor 239 and the shaft 241, while having an increased number of component parts, with a lowered accuracy in and reduced adaptiveness for their assemblage.

SUMMARY OF THE INVENTION

The present invention has been achieved with such points in view.

It therefore is an object of the present invention to provide a cooling system adaptive for an open cycle, relatively high of efficiency as well as of durability due to a lowered burden on bearings and a reduced loss of drive power, and simple in structure, having a smaller number of component parts, permitting a facilitated assemblage and a reduced cost.

To achieve the object, a first aspect of the invention provides a cooling system comprising a compressor for compressing air, a cooler for cooling high-temperature high-pressure air delivered from the compressor, an expander for effecting adiabatic expansion of air cooled by the cooler, the expander having a rotor coupled with a rotor of the compressor, and a speed change mechanism for transmitting drive torque of a prime mover to the compressor, wherein the expander is interposed between the speed change mechanism and the compressor.

According to the first aspect, an expander that generates positive pressures is interposed between a speed change mechanism and a compressor, and oil leakage from the speed change mechanism to the compressor is effectively prevented, without mixing oil into compressed air, unlike the conventional example of FIG. 1 where the compressor 209 is arranged next to the reduction gear 213.

It therefore is possible to deliver cold air from the expander directly into a residential space, allowing for a cooling system to have an open cycle.

Accordingly, no oil separator for removing oil from cold air is necessary, and an increase in cost can be prevented. Further, without the need for a closed cycle using an evaporator, the cooling system can be compact in size and light-weighted, with a reduced cost and an increased efficiency.

According to a second aspect of the invention, the speed change mechanism, the expander and the compressor are arranged on a common shaft.

According to the second aspect, a speed change mechanism, an expander and a compressor are mounted on a common shaft, allowing a reduced number of component parts, without the need for alignment between separated shafts to be achieved with high accuracy by a precise processing, permitting an efficient assemblage, unlike the conventional example of FIG. 2 where the rotor 239 of the turbine 231 and the shaft 241 at the reduction gear set 237 side are separated.

According to a third aspect of the invention, the cooling system further comprises a thrust bearing interposed between the expander and the compressor, for bearing thrust loads from the rotors thereof.

According to the third aspect, the provision of a thrust bearing between an expander and a compressor permits an efficient assemblage to be achieved with assembly errors of respective associated members absorbed between the expander and the compressor, without being accumulated, allowing for gaps to be adequately adjusted between a respective rotor and a housing thereof, avoiding a reduction in thermal efficiency of adiabatic expansion of cooled compressed air, unlike the conventional example of FIG. 1 where the thrust bearing is arranged at the reduction rear 213 side.

According to a fourth aspect of the invention, the speed change mechanism includes a sun gear supported at both sides in an axial direction thereof.

According to the fourth aspect, as a sun gear of a speed change mechanism is supported at both axial sides, imposed loads are evenly shared, preventing an overloading on either side, and friction losses at associated bearings as well as of drive power from a prime mover are reduced, permitting an improved durability, unlike the conventional example of FIG. 1 where the sun gear 249 of the reduction gear 213 is supported at one side by the bearings 246 and 247.

According to a fifth aspect of the invention, a suction part and a discharge part of a housing of the expander are integrated with each other, and a sun gear of the speed change mechanism is supported by the housing.

According to the fifth aspect, a suction part and a discharge part of a housing of an expander are formed to be integral with each other and a sun gear of a speed change mechanism is supported by the housing, without the need for alignment of those members to be achieved with high accuracy by a precise processing, avoiding costs therefor and potential disorder of alignment or vibrations, permitting a high speed rotation with an improved durability, unlike the conventional example of FIG. 1 where the housing 215 is a separate unit and the pinion gear 223 of the reduction gear 213 is supported by the flange 227 as a separate member of the housing 215.

Further, as no bolts are necessary for joining the separate members, the number of component parts can be reduced, allowing an efficient assemblage.

According to a sixth aspect of the invention, cold air is delivered from the expander to one of a vehicle passenger room, a residential space and a refrigerator chamber, as a load to be cooled, and warmed air from the load is compressed by the compressor.

According to the sixth aspect, the cooling system has an open cycle in which cold air can be supplied for a direct air conditioning of a cooling load such as a vehicle passenger room or a residential space or for a direct freezing of a freezing load such as a freezing chamber of a refrigerator car.

Further, the cooling system is permitted to be simple in structure, compact in size, light-weighted, low of cost, with an improved COP, in particular for application to automobiles.

The foregoing aspects of the invention may be defined from other aspects.

According to a seventh aspect of the invention, a cooling system comprises a drive power source for generating drive power as torque with a first revolution speed, a speed change mechanism for transmitting the drive power as torque with a second revolution speed changed from the first revolution speed, a compressor having a first rotor operable with first torque transmitted from the speed change mechanism, for compressing a body of suctioned air to provide a body of hot compressed air, a cooler for cooling the body of hot compressed air to provide a body of cooled compressed air, an expander having a second rotor for expanding the body of cooled compressed air to provide a body of cold air, the second rotor receiving second torque transmitted from the speed change mechanism and third torque due to expansion of the body of cooled compressed air, the expander being interposed between the speed change mechanism and the compressor, and coupling means for coupling the first and second rotors with each other.

According to an eighth aspect of the invention, the coupling means comprises a common shaft member for transmitting the first and second torque from the speed change mechanism to the first and second rotors, respectively, and feeding back a fraction of the third torque from the first rotor to the second rotor.

According to a ninth aspect of the invention, the cooling system further comprises a thrust bearing for supporting the common shaft member between the first and second rotors.

According to a tenth aspect of the invention, the first and second rotors are oriented so that the common shaft member receives a first thrust load acting thereon in a sense of an axial direction thereof from the first rotor, as it is rotated with the first torque, and a second thrust load acting thereon in an opposite sense of the axial direction from the second rotor, as it is rotated with the third torque.

According to an eleventh aspect of the invention, the speed change mechanism comprises a speed increasing planetary gear set including a sun gear fixed on the common shaft member.

According to a twelfth aspect of the invention, the cooling system comprises a pair of hydraulically floating radial bearings for supporting the common shaft member, either between the first and second rotors, and the other between the sun gear and the second rotor.

According to a thirteenth aspect of the invention, the cooling system comprises a pair of hydraulically floating radial bearings for supporting the common shaft member, either at both sides of the sun gear.

According to a fourteenth aspect of the invention, the body of cold air is delivered to an open space, and the body of suctioned air is suctioned from the open space.

BRIEF DESCRIPTION OF THE ACCOMPANYING DRAWINGS

Figure 3:
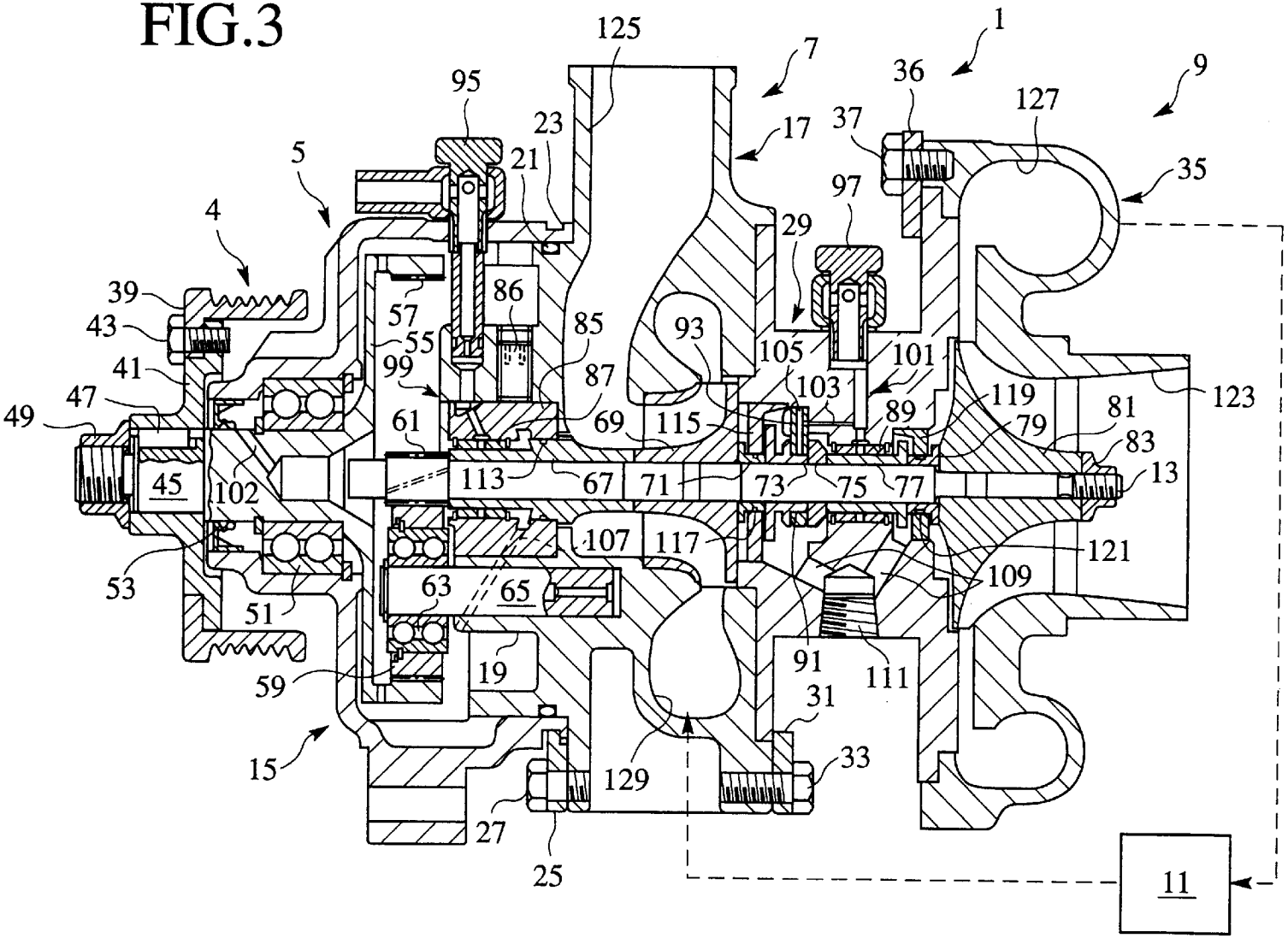
Figure 4:
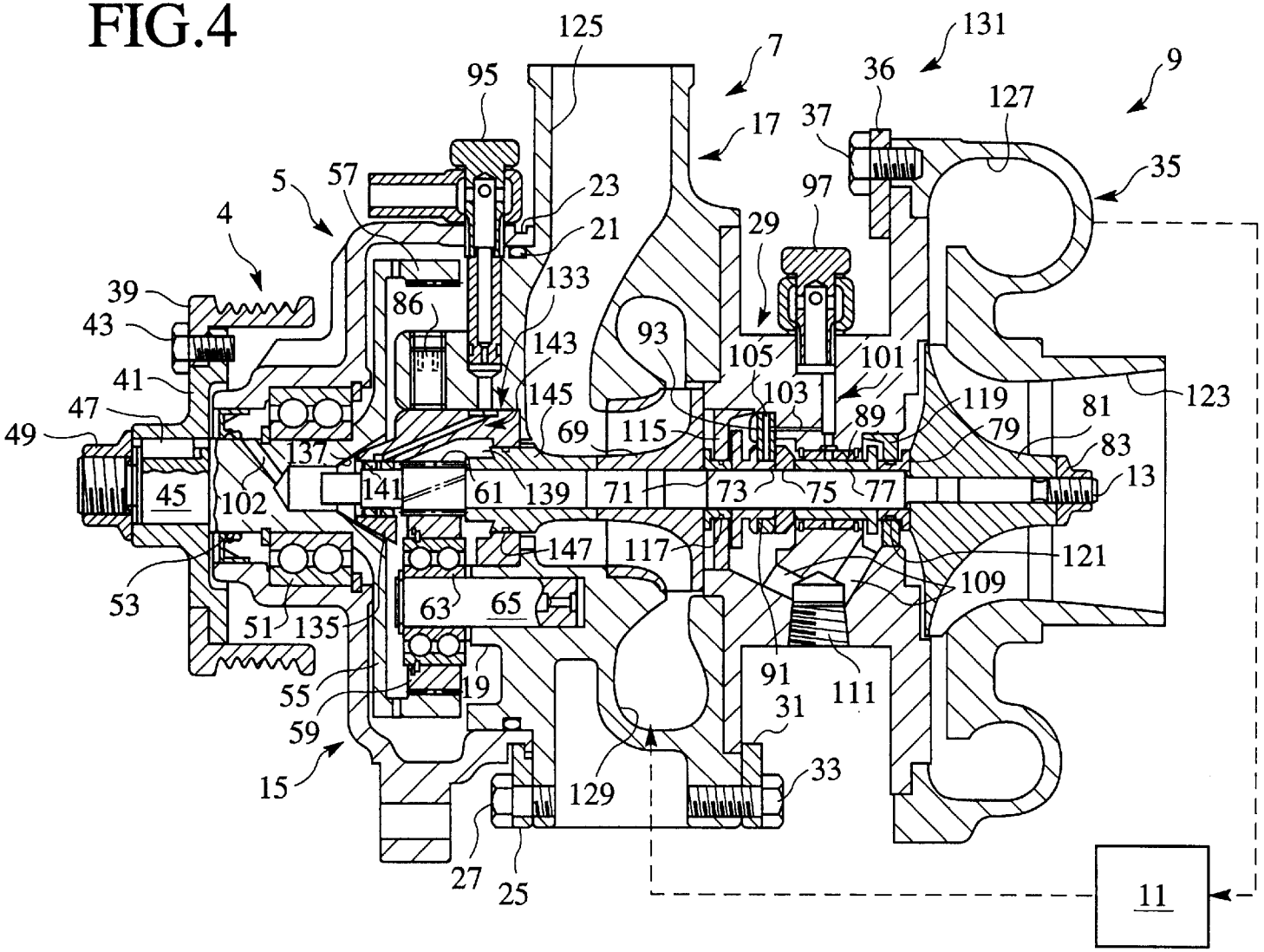
Figure 5:
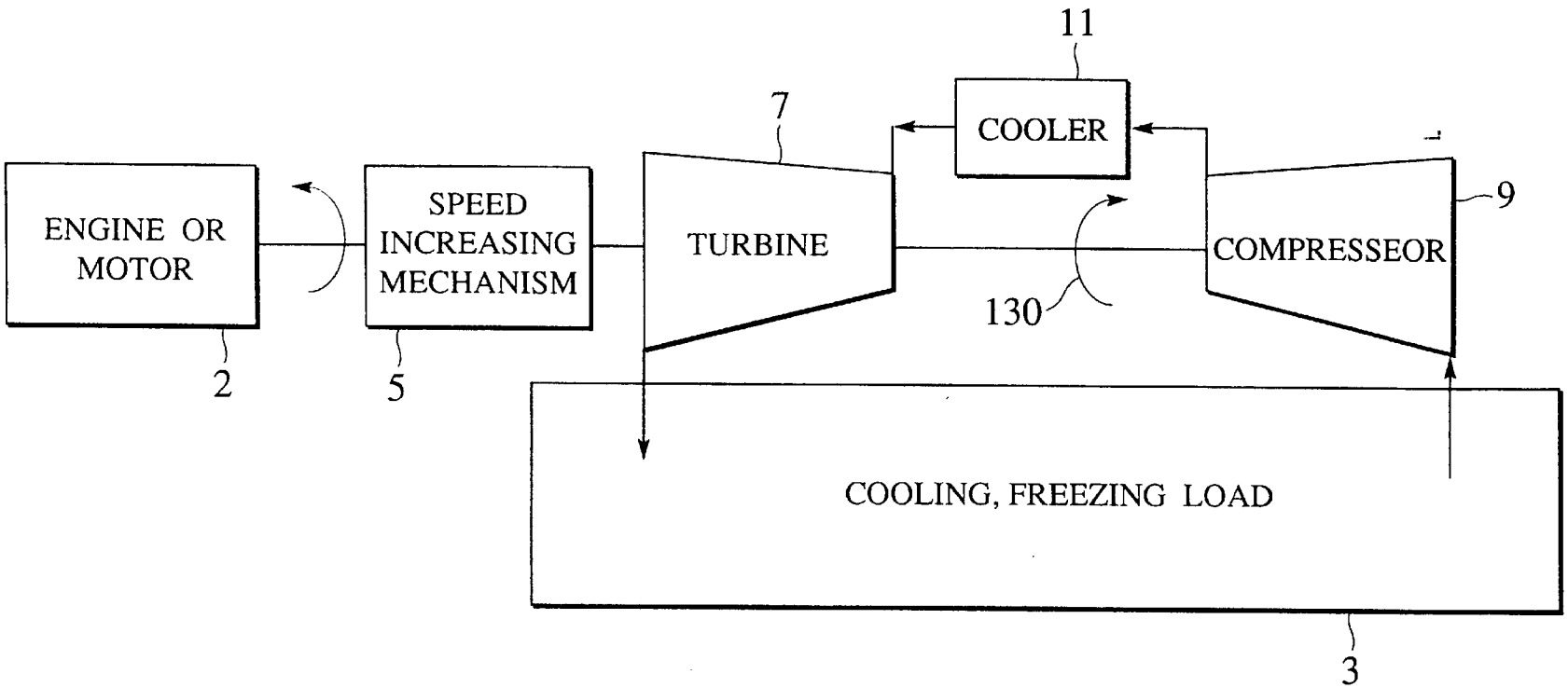

The above and further objects and novel features of the present invention will more fully appear from the following detailed description when the same is read in conjunction with the accompanying drawings, in which:

FIG. 1 is a section of a conventional gas turbine apparatus;

FIG. 2 is a section of another conventional gas turbine apparatus;

FIG. 3 is a section of a cooling assembly including a speed change mechanism, an expander and a compressor of a cooling system according to an embodiment of the invention;

FIG. 4 is a section of a cooling assembly including a speed change mechanism, an expander and a compressor of a cooling system according to another embodiment of the invention; and FIG. 5 is a common block diagram of the cooling systems of FIGS. 3 and 4.

DETAILED DESCRIPTION OF THE PREFERRED EMBODIMENTS

There will be detailed below the preferred embodiments of the present invention with reference to the accompanying drawings. Like members are designated by like reference characters.

A first embodiment of the invention will be described with reference to FIGS. 3 and 5. The first embodiment has characteristics of the first to the fourteenth aspect of the invention, excepting the fourth and the thirteenth aspect. FIG. 5 is a block diagram describing a cooling system according to the first embodiment, and FIG. 3, a section of a cooling assembly 1 employed in the cooling system. The cooling system is a Freon-less type using air as a coolant and kind to the ozone layer.

The cooling system of FIG. 5 is installed in a vehicle that may be an automobile or refrigerator car, and comprises a drive power source 2, the cooling assembly 1, a cooler 11, and a cooling or freezing load 3. The drive power source 2 comprises an engine or an electric motor powered from a battery of the vehicle. The cooling assembly 1 comprises a speed increasing mechanism 5, a turbine 7 and a compressor 9. The cooler 11 comprises a heat exchanger. The load 3 is a volume of air to be cooled, and may be a passenger room of the vehicle, as a cooling load, or a refrigerating space of a refrigerator car, as a freezing load.

As shown in FIG. 3, the cooling assembly 1 comprises a drive power input pulley 4, the speed increasing mechanism 5 as a speed change mechanism of a planetary gear type, the turbine 7 as an air expander of a centrifugal type, and the compressor 9 as an air compressor of a centrifugal type.

The speed increasing mechanism 5, the turbine 7 and the compressor 9 are all mounted on a common impeller shaft 13, in this sequence.

The speed increasing mechanism 5 has a gear casing 15 provided with an oil reservoir.

The turbine 7 has a housing 17 formed as a single member. A flange portion 19 of the turbine housing 17 is fitted in the gear casing 15, with an oil sealing O-ring 21 intervening therebetween, and is fixed thereto with a plurality of locking pieces 25 engaging with a circumferential groove 23 of the casing 15, while the locking pieces 25 are each fixed to the housing 17 by bolts 27.

The turbine housing 17 has a right end part thereof formed with a recessed face, where a left flange part of a hollowed flange member 29 mounted on the impeller shaft 13 is fitted and secured with a plurality of locking pieces 31 pressing the left flange part from outside, while the locking pieces 31 are each fixed by bolts 33 to the right end of the housing 17. The flange member 29 has a right flange part, which is fitted in an opening closing manner in a stepped left end part of a housing 35 of the compressor 9 and secured thereto with a plurality of locking pieces 36 pressing the right flange part from outside, while the locking pieces 36 are each fixed by bolts 37 to the left end part of the compressor housing 17.

The input pulley 4 comprises a main body 39 and a hub 41 fixed thereto by bolts 43. The hub 41 is secured by a key 47 to an input shaft 45 of the speed increasing mechanism 5 and fixed in position by a nut 49.

The input pulley 4 is belt-driven from an unshown drive pulley operatively connected to a crankshaft of the engine, and receives therefrom necessary drive power as torque with a controlled revolution speed.

The input shaft 45 is supported with a bearing 51 fixed in the gear casing 15 of the speed increasing mechanism 5, while a seal 53 for oil leak prevention is interposed between the input shaft 45 and the casing 15.

The speed increasing mechanism 5 includes a helical internal gear 57 as a ring gear formed inside an axial extension of an integral radial flange portion 55 of the input shaft 45, a helical sun gear 61 formed on the impeller shaft 13, and a plurality of equi-angularly spaced helical pinion gears 59 as planetary gears intermeshing between the ring gear 57 and the sun gear 61.

Meshing parts of the respective gears of the speed increasing mechanism 5 are lubricated by oil splashed from the oil reservoir.

Each pinion gear 59 is supported with a bearing 63 fixed on a pinion shaft 65 axially projecting from the flange portion 19 of the turbine housing 17.

The impeller shaft 13 has mounted thereon a bush 67, an impeller 69 as a rotor of the turbine 7, another bush 71, a pair of left and right rings 73, 75, a pair of left and right bushes 77, 79, and another impeller 81 as a rotor of the compressor 9, which are ordered in this sequence on a right hand of the sun gear 61 and fixed tight by a nut 83 screwed on a right end of the shaft 13.

The impellers 69, 81 are directly coupled to the impeller shaft 13, and are arranged in an opposing relation to each other, thereby canceling their thrust forces.

The flange portion 19 of the turbine housing 17 has a bearing holder 85 press-fitted therein and secured by bolts 86. The bearing holder 85 cooperates with the bush 67 to hold therebetween a floating bush 87 as a radial bearing. Likewise, the flange member 29 cooperates with the bush 77 to hold therebetween a floating bush 89 as another radial bearing. The floating bushes 87, 89 cooperate with each other to rotatably support the impeller shaft 13 together with the respective elements mounted thereon.

The pair of left and right rings 73, 75 cooperatively define a groove 91 therebetween, where is fitted a thrust washer 93 as a thrust bearing that bears thrust loads due to thrust forces acting on the impeller shaft 13 from the respective impellers 69, 81 of the turbine 7 and the compressor 9 and those from the sun gear 61 meshing in the speed increasing mechanism 5.

In this respect, the impellers 69, 81 are oriented in opposite directions to each other so that their thrust forces cancel each other as described, effectively reducing the loads to be imposed on the thrust washer 93 in the groove 91, permitting them 91, 93 to have an enhanced durability.

The gear casing 15 is provided with an oil plug 95, which is connected at an upstream end thereof to an unshown external controllable hydraulic oil pump and at a downstream end thereof, via one or more radial oil paths 99 formed through the flange portion 19 of the turbine housing 17 and the bearing holder 85 fitted therein, to hydraulic holes or slits provided through (or between elements of) the floating bush 87. The flange member 29 also is provided with an oil plug 97, which is connected at an upstream end thereof to the external pump and at a downstream end thereof, via one or more radial oil paths 101 formed through the member 29, to hydraulic holes or slits provided through (or between elements of) the floating bush 89.

The external pump supplies hydraulic oil inside each floating bush 87, 89, where it constitutes a damping oil film that absorbs vibrations, supporting the floating bush 87, 89, whereby the impeller shaft 13 is supported in position at both ends in a stabilized manner.

The hydraulic oil supplied inside the floating bush 87 is delivered, at a left end of the bush 87, for additional lubrication to meshing parts of gears of the speed increasing mechanism 5, before return to the oil reservoir. Further, part of the hydraulic oil is sent to the bearing 51 and the seal 53 for lubrication through an oil path 102 formed in the input shaft 45.

On the other hand, the hydraulic oil supplied inside the floating bush 89 is delivered through a groove 103 formed in a body of the flange member 29 and an oil path 105 in the thrust washer 93, for lubrication to sliding parts between the thrust washer 93 and the groove 91, i.e., of rings 73, 75.

Further, part of the hydraulic oil constituting the damping oil film inside the floating bush 87 returns to the oil reservoir in the casing 15 through a return oil path 107, while the hydraulic oil inside the floating bush 89 is discharged outside via an oil path 109 and an oil drain 111 provided through the flange member 29.

A ring seal 113 is fitted between the bush 67 and the bearing holder 85, for preventing oil leakage from the casing 15 and air leakage from the turbine 7.

In addition, as the turbine 7 whose internal pressure is positive pressure is arranged next to the speed increasing mechanism 5 whose internal pressure is atmospheric, oil leakage is effectively prevented between the speed increasing mechanism 5 side to the turbine 7 side.

Still more, another ring seal 117 is fitted between a left sealing element 115 of the flange member 29 and the bush 71, for preventing oil leakage from the flange member 29 side and air leakage from the turbine 7.

Yet more, another ring seal 121 is fitted between a right sealing element 119 of the flange member 29 and the bush 79, for preventing oil leakage from the flange member 29 side and air leakage from the compressor 9.

The compressor 9 has an air suctioning inlet 123 opened in the housing 35 thereof and connected to the load 3 (FIG. 5) via a duct, and the turbine 7 has an air discharging outlet 125 opened in the housing 17 thereof and connected to the load 3 via another duct.

The cooler 11 is installed in an air piping or ducting between an air discharging outlet 127 opened in the housing 35 of the compressor 9 and an air receiving inlet 129 opened in the housing 17 of the turbine 7.

The turbine housing 17 is lined with an insulating material for suppressing temperature rise of cold air.

Drive power from the engine 2 (FIG. 5) is in put as drive torque with a revolution speed through the input pulley 4 and the input shaft 45 to the speed increasing mechanism 5, where it is transmitted via the internal ring gear 57, the planetary pinion gears 59 and the sun gear 61 to the impeller shaft 13, as drive torque with an increased revolution speed for driving to rotate the impellers 69, 81 of the turbine 7 and the compressor 9.

The compressor 9 suctions air from the load 3 and compresses suctioned air to provide hot compressed air, i.e. high-temperature high-pressure air, which runs through the cooler 11, where it is cooled. And, cooled compressed air runs into the turbine 7, where it is expanded in an adiabatic manner, thus getting colder, giving additional torque to the impeller 69, and cold air is delivered from the turbine 7 to the load 3, where it may be warmed on the way of draft before the suction into the compressor 9.

In this cycle of the cooling system of FIG. 5, the air is subjected as a coolant to adiabatic (equi-entropy) volume changes at the turbine 7 and the compressor 9 and equi-pressure volume changes in the load 3 and the cooler 11.

In this way, the cooling system of FIG. 5 has an open cycle in which cold air from the turbine 7 is delivered directly to the load 3.

Further, in the cooling assembly 1, part of the torque acting on the turbine impeller 69 is positively fed back through the impeller shaft 13 to the compressor impeller 81, as shown by an arrow 130 in FIG. 5, to enhance rotation moment of the compressor 9 and reduce a load fed back through the speed increasing mechanism 5 to be imposed on the engine 2. Energy is recovered in this way, and the efficiency of the cooling assembly 1 is improved.

In the cooling assembly 1 arranged as described, the turbine 7 that generates positive pressures is interposed between the speed increasing mechanism 5 and the compressor 9, effectively preventing oil leakage from the speed change mechanism 5 side to the turbine 7 side, thereby avoiding mixing oil in cold air, unlike the conventional example of FIG. 1, thus permitting the cold air to be delivered directly to the load 3, as an advantage of the open cycle.

It therefore is unnecessary to remove oil from cold air by using an expensive oil separator, without a conventional cost therefor. Since a closed cycle is not employed, the use of an evaporator is not required, permitting the cooling system to be simple in structure, compact in size, light-weighted, with a reduced costs and an improved COP.

Moreover, the speed change mechanism 5, the turbine 7 and the compressor 9 are all arranged on the single impeller shaft 13, with a decreased number of component parts, without the need for alignment between shafts nor precise processing with high accuracy, achieving an improved assemblage, unlike the conventional example of FIG. 2.

Further, the thrust washer 93 is arranged between the turbine 7 and the compressor 9, allowing an efficient assemblage with assembly errors of associated members absorbed between the turbine 7 and the compressor 9, preventing an accumulation of such assembly errors, permitting gaps to be adjusted between the respective impellers 69 and 81 and the turbine and compressor housings 17 and 35, avoiding reduction of temperature efficiency along adiabatic changes, unlike the conventional example of FIG. 1.

Accordingly, no consideration is necessary for an abradable coating to adjust a gap between each impeller 69, 81 and housing 17, 35, and a cost increase is avoidable.

Furthermore, the housing 17 of the turbine 7 comprises a single integrated member and the sun gear 61 (on the impeller shaft 13) of the speed change mechanism 5 is supported by the (flange portion 19 of) the housing 17, resulting in an effectively reduced processing cost, permitting the cooling assembly 1 to perform a high-speed rotation with an improved durability without undue alignment or vibrations, unlike the conventional example of FIG. 1.

Still more, as no conventional bolts are necessary for fastening separate members, the cooling assembly has the more reduced number of component parts, permitting the more improved assemblage.

Yet more, the turbine 7 and the compressor 9 are isolated from each other with the flange member 29 therebetween, without needing an insulation material to interrupt heat transmission from the compressor 9 to the turbine 7, resulting in the more reduced cost.

Still further, the open-cycle cooling assembly 1 is simple in structure, compact in size, light weighted, low of cost, and efficient in COP and by far suitable for application to air conditioning of a vehicle passenger room, as well as to freezing in a freezing chamber of a refrigerator car.

A second embodiment of the invention will be described with reference to FIGS. 4 and 5. This embodiment has characteristics of the first to the fourteenth aspect of the invention, excepting the twelfth aspect. FIG. 4 shows a cooling assembly 131 according to the second embodiment.

Like the cooling assembly 1 of the first embodiment, the cooling assembly 131 comprises an input pulley 4, a planetary gear type speed increasing mechanism 5, a centrifugal turbine 7, a centrifugal compressor 9, and a cooler 11. The speed increasing mechanism 5, the turbine 7 and the compressor 9 are arranged in this sequence on an impeller shaft 13.

A bearing holder 133 is press-fitted to a flange portion 19 of a turbine housing 17, and is fixed by bolts 86. At the left end of the bearing holder 133, there is formed a conical projection part 135, which is fitted in a conical recess part 137 formed at a right end of an input shaft 45, with a slight gap in between. A recess part 139 is formed in the bearing holder 133 to prevent interferences with a sun gear 61.

On the left side of the sun gear 61, a floating bushing 141 is fitted as a radial bearing between the impeller shaft 13 and the bearing holder 133.

Hydraulic oil is supplied from an oil plug 95, via an oil path 143 formed through the flange portion 19 and the bearing holder 133, inside the floating bushing 141, where it constitutes a damping oil film. The floating bushing 141 is supported by the oil film in a floating manner, and supports the impeller shaft 13 as well as respective members thereon, effectively absorbing vibrations.

The sun gear 61 is supported at a left end thereof with the floating bushing 141, and at a right part thereof with a floating bush 89.

Hydraulic oil supplied inside the floating bushing 141 is delivered also to the speed increasing mechanism 5, where it lubricates meshing parts of the mechanism 5, before return to an oil reservoir.

At a right side of the sun gear 61, there is a bushing 145 fitted between the impeller shaft 13 and the bearing holder 133. A seal 147 is arranged between the bushing 145 and the bearing holder 133, for preventing oil leakage from the casing 15 and air leakage from the turbine 7.

In the second embodiment also, the turbine 7 generating positive pressures is disposed next to the speed increasing mechanism 5, and oil leakage from the speed increasing mechanism 5 side to the turbine 7 side is effectively prevented.

In the cooling assembly 131, the sun gear 61 is supported at both sides in an axial direction thereof by the left and right floating bushings 141, 89, i.e., the left floating bush 141 is disposed on the left side of the sun gear 61. As a result, imposed loads are evenly shared between the floating bushings 14, 89, preventing an overloading at either side, unlike the conventional example of FIG. 1.

Accordingly, there are reduced friction losses at the floating bushes 141, 89 as well as drive power loss of the engine, permitting an improved durability.

In will be seen that the cooling assembly 131 has similar effects to the cooling assembly 1.

While preferred embodiments of the present invention have been described using specific terms, such description is for illustrative purposes, and it is to be understood that changes and variations may be made without departing from the spirit or scope of the following claims.

What is claimed is:

1. A cooling system comprising:

a compressor having a first rotor for compressing air;

a cooler for cooling high-temperature high-pressure air delivered from the compressor;

an expander having a second rotor for effecting adiabatic expansion of air cooled by the cooler;

a speed change mechanism operatively connected to a prime mover; and a common shaft extending through the first and second rotors, driven by the speed change mechanism for driving the first and second rotors, wherein the expander is interposed between the speed change mechanism and the compressor.

2. The cooling system according to claim 1, wherein the common shaft extends through the speed change mechanism.

3. The cooling system according to claim 1, further comprising a common thrust bearing interposed between the first and second rotors, for bearing thrust forces acting on the thrust bearing in opposite senses from the first and second rotors thereof.

4. The cooling system according to claim 1, wherein the speed change mechanism further comprises a sun gear supported at both axial ends thereof.

5. A cooling system according to claim 1, wherein:

a suction part and a discharge part of a housing of the expander are integrated with each other; and a sun gear of the speed change mechanism is supported by the housing.

6. A cooling system according to claim 1, wherein:

cold air is delivered from the expander to one of a vehicle passenger room, a residential space and a refrigerator chamber, as a load to be cooled; and warmed air from the load is compressed by the compressor.

7. A cooling system comprising:

a drive power source for generating drive power as torque with a first revolution speed;

a speed change mechanism for transmitting the drive power as torque with a second revolution speed changed from the first revolution speed;

a compressor having a first rotor operable with first torque transmitted from the speed change mechanism, for compressing a body of suctioned air to provide a body of hot compressed air;

a cooler for cooling the body of hot compressed air to provide a body of cooled compressed air;

an expander having a second rotor for expanding the body of cooled compressed air to provide a body of cold air, the second rotor receiving second torque transmitted from the speed change mechanism and third torque due to expansion of the body of cooled compressed air, the expander being interposed between the speed change mechanism and the compressor; and a common shaft member extending through the first and second rotors for transmitting the first and second torque from the speed change mechanism to the first and second rotors, respectively, and feeding back a fraction of the third torque from the first rotor to the second rotor.

8. The cooling system according to claim 7, wherein the common shaft member extends through the speed change mechanism.

9. The cooling system according to claim 8, further comprising a common thrust bearing interposed between the first and second rotors for bearing thrust forces acting on the thrust bearing in opposite senses from the first and second rotors.

10. The cooling system according to claim 7, wherein the first and second rotors are oriented so that the common shaft member receives a first thrust load acting thereon in a sense of an axial direction thereof from the first rotor, as the common shaft member is rotated with the first torque, and a second thrust load acting thereon in an opposite sense of the axial direction from the second rotor, as the common shaft member is rotated with the third torque.

11. The cooling system according to claim 7, wherein the speed change mechanism comprises a speed increasing planetary gear set including a sun gear provided on the common shaft member.

12. The cooling system according to claim 11, further comprising a pair of hydraulically floating radial bearings for supporting the common shaft member, one radial bearing disposed between the first and second rotors, and the other between the sun gear and the second rotor.

13. The cooling system according to claim 11, further comprising a pair of hydraulically floating radial bearings for supporting the common shaft member at both axial ends of the sun gear.

14. A cooling system according to claim 7, wherein said body of cold air is delivered to an open space, and said body of suctioned air is suctioned from the open space.

* * * * *